United States Patent [19]

Hunt, III et al.

[11] Patent Number: 4,787,864

[45] Date of Patent: Nov. 29, 1988

[54] TERMINAL STABILIZATION AND RETENTION SYSTEM FOR AN ELECTRICAL CONNECTOR

[75] Inventors: Alexander Hunt, III, Harrisburg; John M. Myer, Lancaster; Charles R. Rhoads, Harrisburg; Dennis E. Smith, Elizabethtown, all of Pa.

[73] Assignee: AMP Incorporated, Harrisburg, Pa.

[21] Appl. No.: 30,409

[22] Filed: Mar. 25, 1987

[51] Int. Cl.[4] ..... H01R 13/44

[52] U.S. Cl. ..... 439/595; 439/603; 439/747

[58] Field of Search ..... 439/271, 275, 278, 279, 439/345, 592, 595, 586, 589, 600, 603, 634, 637, 744, 747–748

[56] References Cited

U.S. PATENT DOCUMENTS

| | | | |
|---|---|---|---|
| 3,009,130 | 11/1961 | Redslob et al. | 339/176 |
| 3,178,669 | 4/1965 | Roberts | 339/49 |
| 3,187,297 | 6/1965 | Gluntz | 339/217 |
| 3,319,212 | 5/1967 | Smith et al. | 339/64 |
| 3,440,597 | 4/1969 | Baker, II et al. | 339/221 |
| 3,444,504 | 5/1969 | Lynch et al. | 339/64 |
| 3,487,355 | 12/1969 | Cairns | 339/176 |
| 3,601,760 | 8/1971 | Cairns | 339/59 |
| 3,686,619 | 8/1972 | McCardell, Jr. et al. | 339/59 M |
| 3,697,927 | 10/1972 | Kunkle et al. | 339/176 M |
| 4,066,325 | 1/1978 | Pearce, Jr. et al. | 439/634 |
| 4,443,048 | 4/1984 | Moist, Jr. | 339/63 M |
| 4,445,748 | 5/1984 | Evans | 339/94 M |
| 4,544,220 | 10/1985 | Aiello et al. | 439/600 |
| 4,557,542 | 12/1985 | Coller et al. | 439/595 |
| 4,565,416 | 1/1986 | Rudy et al. | 439/592 |
| 4,602,839 | 7/1986 | Winger | 439/747 |
| 4,655,525 | 4/1987 | Hunt, III et al. | 339/63 M |

FOREIGN PATENT DOCUMENTS

| | | |
|---|---|---|
| 3129405A1 | 7/1981 | Fed. Rep. of Germany . |
| 57-192076 | 12/1982 | Japan . |
| 59-36860 | 10/1984 | Japan . |

OTHER PUBLICATIONS

AMP Document C1-8050-72, "Crimp Inspection", AMP Incorporated, Harrisburg, Pa. (1983).

AMP Institute Visual Aid 9-F Rev. C., "Contact Insertion", AMP Incorporated, Harrisburg, Pa. (1975).

*Primary Examiner*—Gil Weidenfeld
*Assistant Examiner*—Paula A. Austin
*Attorney, Agent, or Firm*—Anton P. Ness

[57] ABSTRACT

An electrical connector assembly of terminals terminated to conductors of cables assures the retention of the terminals in the passageways of the housing by an insert member inserted into a transverse cavity at the cable-receiving face along one side of the cables of a row after the terminated terminals are fully inserted. The insert member has forwardly facing stop surfaces which engage rearwardly facing stop surfaces of annuli of the terminals at rearward ends thereof spaced away from the cable insulation. The terminals are preferably primarily retained in the passageways by conventional means so that the insert is a secondary retention means. The insert is secured such as by a pair of latch arms at ends thereof which latch to the housing when the insert's stop surfaces engage those of the terminals of the row. The terminal annuli can engage corresponding passageway wall portions in any angular direction to limit lateral movement in all directions and thus stabilize the terminal in axial alignment within the passageway in cooperation with the primary retention means forwardly thereof. The stabilization is present even in the absence of the insert member.

7 Claims, 5 Drawing Sheets

TERMINAL STABILIZATION AND RETENTION SYSTEM FOR AN ELECTRICAL CONNECTOR

FIELD OF THE INVENTION

This relates to the field of electrical connectors and more particularly to connectors having terminals which are insertable into a housing after termination to a conductor.

BACKGROUND OF THE INVENTION

Various means are known to secure terminals inside of cavities of a housing. These include the use of potting compound, spring clips and the like. Especially in a multiterminal housing it is important that all terminals be held securely and in accurate alignment during assembly and handling of the housing and during mating with a corresponding housing which may involve significant insertion force, to maintain the precise alignment of many terminals with their counterpart terminals. Such concerns are also important during in-service use of the housing and during disengagement of one housing from the other when a terminal therein may be subjected to tensile force or tugging and possibly become dislodged from or loosened within its cavity.

U.S. Pat. No. 4,066,325 discloses a lock plate insertable into a connector housing's rear slot adjacent an associated row of terminated conductors secured in the housing. Each lock plate latchably secures to the housing and secures the stamped and formed channel-shaped terminals of that row in their respective passageways forwardly of the lock plate, by means of engaging perpendicular tabs of each terminal. Two such plates can secure two rows of terminals in the housing. The lock plate is said to move any partially seated terminals to a fully seated position, during insertion of the lock plate into the housing.

Japanese Patent Publication No. 57-192076 discloses a plate-shaped spacer insertable into a housing adjacent its one row of terminated conductors, and having forwardly extending portions each associated with a respective terminal. The front surface of each such portion engages behind a radially extending projection of the rear section of each of the respective terminals and secures the terminals in respective housing cavities when the spacer is latchingly secured in the housing. The spacer also is shown to engage the spaced cables by a planar surface holding them adjacent the opposing housing wall in a plane. The terminals have rectangular socket contact sections held in correspondingly rectangular housing passageways and must of necessity be inserted in only one angular orientation, with all rear projections having to extend in a common direction to be engaged by the spacer. Use of such a projection on a terminal of circular cross-section would require the burdensome procedure of obtaining the proper angular orientation of the terminated conductor during insertion, and would also require means for securing the terminal against rotation thereafter.

U.S. Pat. No. 4,655,525 discloses a locking insert insertable into a housing cavity between two adjacent rows of terminals, alongside their conductors, to stoppingly engage rearward ends of the terminals to assure that the terminals are fully seated in respective housing cavities, and fully seat those that are not, whereafter the insert latches in the housing to assure that the terminals remain secured in the housing.

It is desirable to have, in addition to a securing means, a secondary means to assure that the terminals remain properly secured within their respective cavities after assembly, during handling and in-service use. It is also desirable to do this in a way which permits disassembly for removal and replacement of terminals, for instance. Further, it is desirable to do this in an economical manner. It is also desirable to provide a means to provide terminal position assurance, that is, a means to actively position a terminal properly within its cavity by moving it axially forwardly until it is seated or latchably secured therein.

It is also desirable to provide a system for secondarily retaining terminals in the housing irrespective of their angular orientation during insertion and after primary retention.

It is further desirable for the terminals terminated to the cables to be laterally stabilized in all angular directions at the rearward terminal ends to maintain axial alignment of the terminals in their respective housing cavities and thereby facilitate proper mating with corresponding terminals or with test equipment.

SUMMARY OF THE INVENTION

According to the present invention, a secondary terminal retention system is provided to assure the retention of terminals in a connector housing which are primarily retained by conventional means located relatively near the mating face of the housing. The terminals of the present invention each include a rearwardmost annulus radially spaced outwardly from the insulation of the conductor to which the terminal is terminated. A locking insert is inserted into a housing recess from rearwardly thereof alongside a row of conductors extending therefrom. The insert has a rearward portion extending transversely toward and to the conductors with its forwardly facing surface comprising stop surface portions engaging the terminals behind the rearward facing annuli surfaces comprising stop sections, to prevent axially rearward movement of the terminals when the insert is secured within the housing. The conductor-proximate surface of the rearward insert portion has semi-cylindrical recesses within which portions of the conductors are disposed, and the stop surface portions are also semi-cylindrical and can engage the terminal stop sections at one or more locations within 180° of each annulus. An opposing housing section can have corresponding opposed channels whereby the opposing pairs of recesses and channels surround respective conductors and limit their position laterally at the rearward housing face. The locking insert may have lateral latching members to latch into latching slots in said connector housing, or into channels along the housing, when said locking insert has been fully inserted into a locking position. Such latching members may be adapted to be disengaged when desired for each removal of said locking insert in order to then remove one or more contact terminals from said housing. During placement, the insert is capable of engaging a terminal not fully inserted, and urging it forwardly into place, providing terminal position assurance.

According to another aspect of the present invention, the rearward terminal annulus stabilizes the rearward end of the terminal in cooperation with cavity walls shaped and dimensioned to be closely spaced around the annulus. Such stabilization provides assurance of substantial axial alignment of the terminal after insertion even in the absence of a locking insert as described above.

It is an objective of the present invention to provide a secondary terminal retention system which is operable on any angular orientation of a terminal.

It is a further objective of the present invention to provide lateral stability to the terminals within the housing assembly to assure appropriate alignment of the terminals.

DETAILED DESCRIPTION OF THE PREFERRED EMBODIMENT

Figure 1:
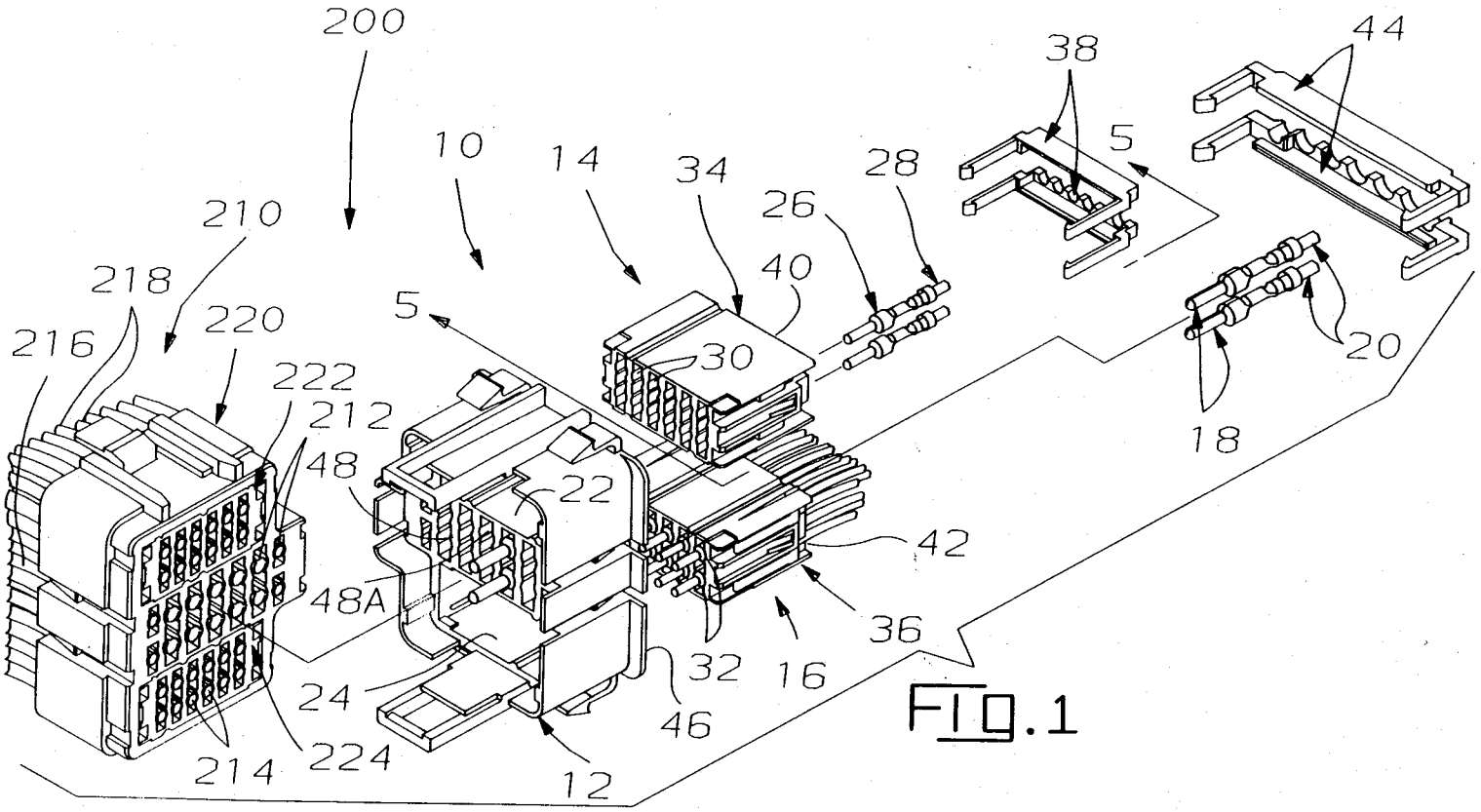
FIG. 1 is a perspective view of a connector assembly with a fully assembled plug connector having socket contacts, and a partly assembled receptacle connector having a shell with one housing member fully assembled exploded therefrom, another like housing member exploded from the shell, and pin terminals and inserts exploded from the like housing and the shell.

FIG. 1 illustrates a matable assembly 200 of mating connector assemblies 10,210 wherein a preferred embodiment of the invention is used. Receptacle connector assembly 10 having arrays of pin terminals comprises a housing shell 12 and two like modules 14,16; shell 12 also has a central region 48 which receives directly thereinto pin terminals 18 terminated to conductors 20. Plug connector assembly 210 is adapted to mate with receptacle connector assembly 10 and contains corresponding arrays of socket terminals 212,214 terminated to conductors 216,218 disposed in a housing shell 220 and modules 222,224 similarly to those of receptacle connector assembly 10. Modules 14,16 are received in a conventional keyed and polarized manner into respective large apertures 22,24 of housing shell 12. Pin terminals 26 are terminated to respective conductors 28 and are received into respective passageways 30,32 of module housings 34,36.

All of the pin terminals 18,26 and socket terminals 212,214 are secured and retained in respective passageways by conventional primary retention means such as deflectable latching arms along the passageways latching behind terminal stop surfaces as in U.S. Pat. Nos. 3,686,619 and 3,971,613. The present invention comprises a secondary system of terminal retention comprising inserts received in respective recesses along cable faces of the housing shells and housing subassemblies alongside rows of conductors as they exit therefrom. Like inserts 38 are received into corresponding recesses along cable faces 40,42 of module housings 34,36 alongside each row of conductors 28, and like inserts 44 are received into corresponding recesses along cable face 46 of housing shell 12 alongside each row of conductors 20. Similar inserts (not shown) are assembled into plug connector assembly 210 along respective rows of conductors 216,218 to assure retention of socket terminals 212,214 therein.

Figure 2A:
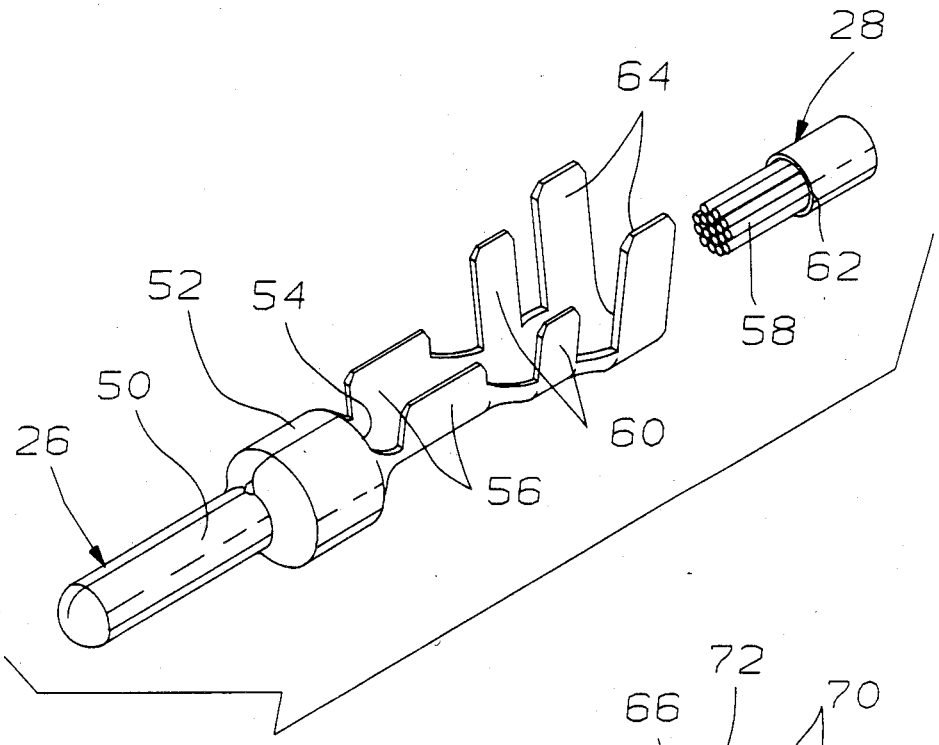
FIGS. 2A and 2B are isometric views of a terminal before and after crimping to a conductor wire.
Figure 2B:
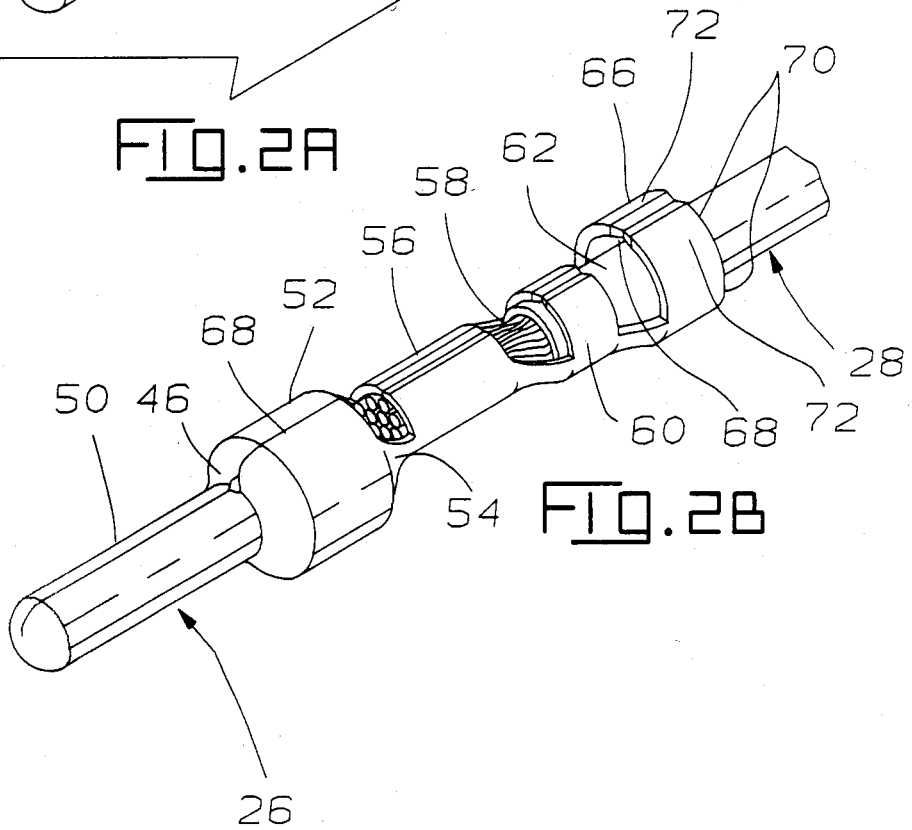

Referring to FIGS. 2A,2B, each pin terminal 26 is stamped and formed and has a pin contact section 50, a large diametered body section 52 defining a rearwardly facing annular stop surface 54, a conductor-connecting section 56 for crimping to the conductive wire 58, and an insulation gripping section 60 for extending around and being crimped to the conductor insulative jacket 62. Tab sections 64 at the rearward end of terminal 26 are formed around the insulative jacket 62 of conductor 28 after or preferably during crimping of insulation gripping section 60 to jacket 62 by appropriate die surfaces of crimping tooling (not shown), to define a preferably round annulus 66 extending substantially completely around conductor 28 to meet at seam 68, and spaced radially from insulative jacket 62, thereby being substantially unengaged with jacket 62. The rearwardly facing edge surface of annulus 66 comprises a stop surface 70 while the outwardly facing surface comprises a stabilizing surface 72. Other pin terminals 18 and socket terminals 212,214 have like structure rearwardly of the contact sections, but may be larger. Annulus 66 would have the same diameter irrespective of the outer diameter of the conductor's insulative jacket and is dependent on the crimping tooling, although the annulus may be slightly out of round. However, both the stabilizing function and the secondary retention function are satisfactorily met in the present invention even if annulus 66 is slightly out of round. Preferably, the outer dimension of annulus 66 is about equal to the outer dimension of body section 52.

Figure 3:
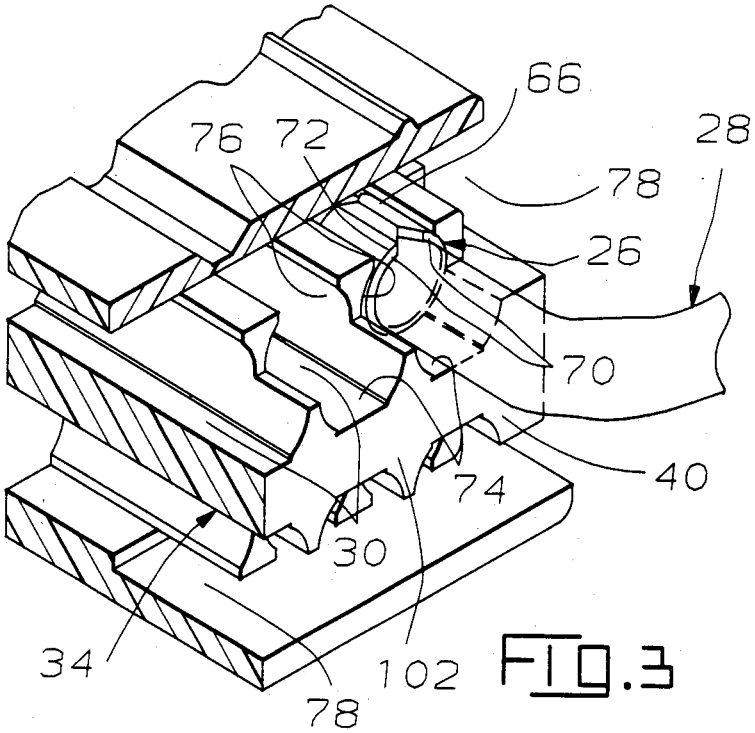
FIG. 3 is a part isometric rear view of a housing enlarged to show passageway wall portions cooperable with the terminal of FIG. 2B for lateral stabilization thereof, prior to placement of an insert.

In FIG. 3 part of cable face 40 of housing 34 has been enlarged to show rearward ends of passageways 30. Channels 74 extend forwardly of cable face 40, and inwardly from cable face 40 are pairs of wall portions 76 extending nearly completely to each other. Wall portions 76 have inside surface dimensions slightly larger than the outer dimension of annulus 66, and wall portions 76 cooperate with the terminal annulus 66 after insertion by being engageable at one or more circumferential locations therewith to laterally stabilize terminal 26 within passageway 30, keeping it in axial alignment so that pin contact section 50 properly mates with an associated socket terminal 214 or with a socket of test equipment (not shown). Also shown adjacent outer surfaces of wall portions 76 is insert-receiving recess 78.

Figure 4:
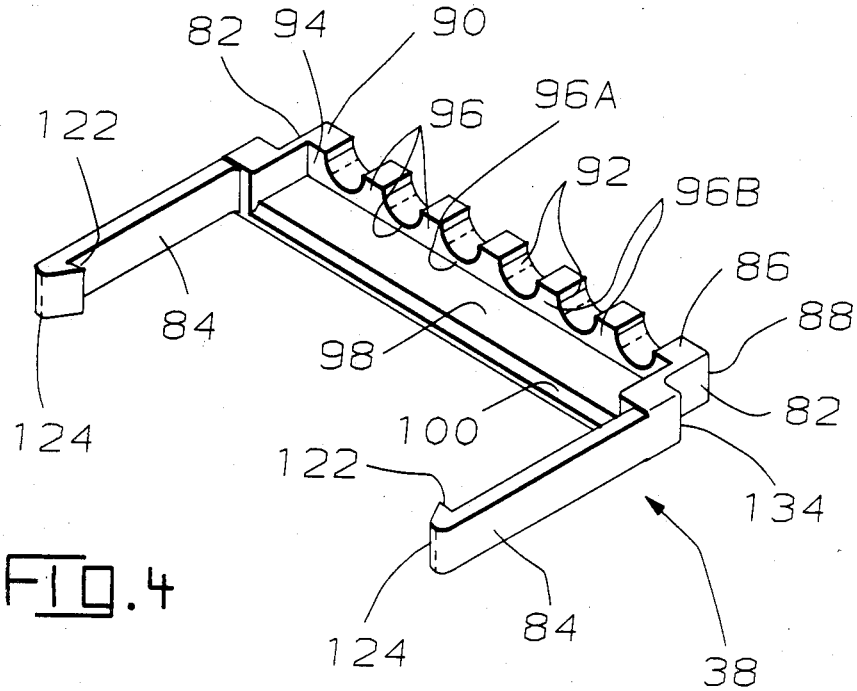
FIG. 4 is a perspective view of an insert of FIG. 1.

Each insert 38, with reference to FIG. 4, has body section 80 having lateral ends 82 forwardly from each of which extends a latch arm 84. Body section 80 includes a cable-proximate portion 86 along rearward end 88 extending normally to the conductor axes which includes a cable-proximate surface 90 having a plurality of semi-cylindrical recesses 92 each associated with a respective conductor upon assembly. Cable-proximate portion 86 defines a forwardly-facing surface 94 comprising stop surfaces 96 at forward ends of the recesses 92. Forwardly from cable-proximate portion 86 is a planar leading portion 98 having a chamfer 100 which comprises a lead-in during assembly, and planar leading portion 98 is disposed along and against outer surfaces of wall portions 76 completing the circumference of passageways 30. Inserts 44 are similar to inserts 38 in shape and function; are larger to extend across cable face 46 of housing shell 12 and are adapted to latch thereto; and have larger, more widely spaced semi-cylindrical recesses corresponding to larger terminals 18 and conductors 20 with centerlines spaced farther apart in central region 48 of shell 12.

Figure 5:
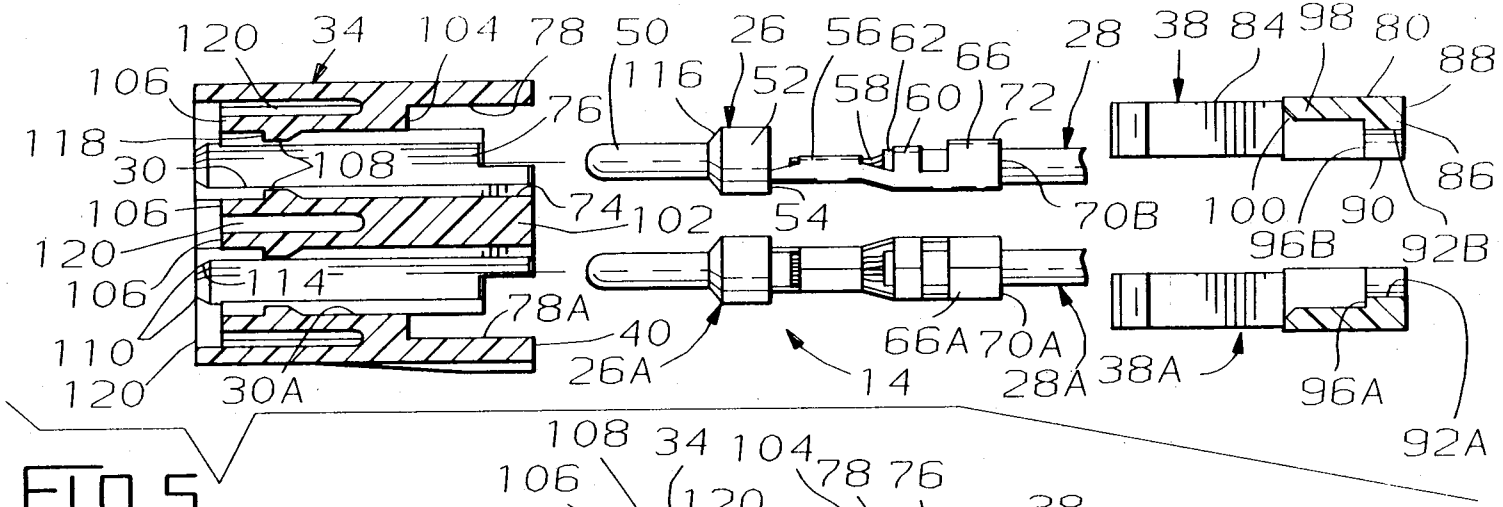
FIG. 5 is a longitudinal section view taken along lines 5—5 of FIG. 1, with terminated conductors in differing orientations.
Figure 6:
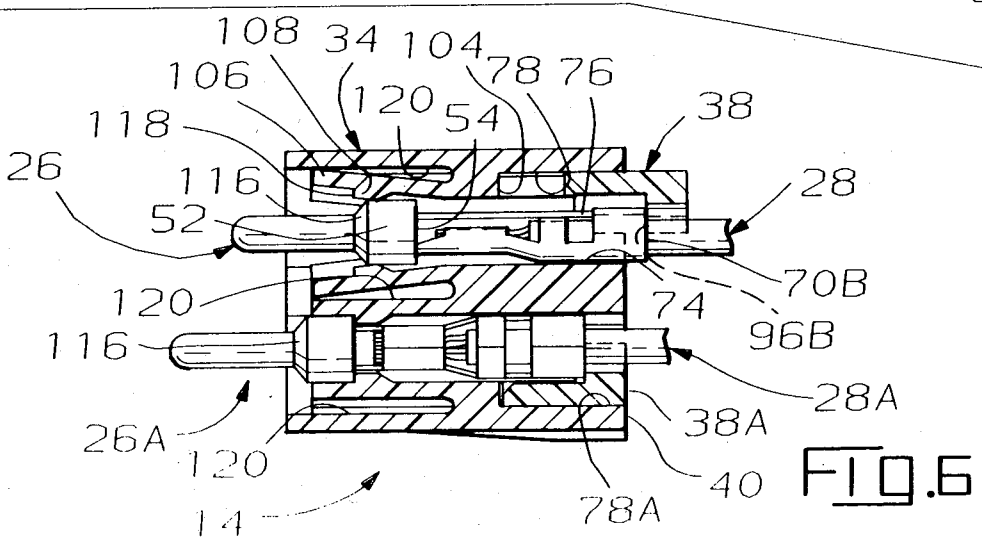
FIG. 6 is a longitudinal section view showing the connector assembly of FIG. 5 in assembled condition, with one terminated conductor not fully seated.

In FIGS. 5 and 6, a representative module housing 34 is shown being loaded with representative pin terminals 26,26A on conductors 28,28A in two rows with a pair of inserts 38,38A to complete a subassembly 14. Wall 102 separates the two rows of passageways 30,30A with channels 74 disposed therealong. The terminated conductors are inserted into cable face 40 in two rows, each into a respective passageway 30,30A. A terminated conductor is inserted first along a respective channel 74 past insert-engaging surface 104 at the front end of insert-receiving recess 78, and into passageway 30. Upper and lower walls of the forward portion of each passageway 30 are comprised of outwardly deflectable latch arms 106 having latching projections 108 extending inwardly. As large diametered terminal body section 52 engages projections 108, latch arms 106 are deflected outwardly and body section 52 passes thereover. Pin contact sections 50 extend through narrowed passageway entrances 110 and extend beyond mating face 112. Tapered surface portions 114 at entrances 110 engage tapered terminal section 116 forwardly of terminal body section 52 to provide a forward stop. Stop surfaces 118 of latch projections 108 latch behind annular terminal stop surface 54 from opposing sides when a terminated conductor is fully seated, comprising a conventional primary terminal retention system preventing axially rearward movement, as shown in FIG. 6.

Lower terminated conductor 26A,28A is shown having an angular orientation about 90° from that of upper terminated conductor 26,28 to demonstrate how the secondary retention system of the present invention accommodates a representative assembly procedure where a myriad of angular orientations are commonplace. Annulus 66A of terminal 26A can have a slightly oblate or flattened shape resulting from the forming process, with slightly widened sides, especially when a terminal is crimped to a smaller diameter conductor wire of a range of adjacent wire sizes. The present invention is especially forgiving and with such variation in the shape of the annulus can easily perform its stabilizing and secondary retention functions. Insert stop surface 96A is seen to easily engage behind widened annulus 66A at lower terminal stop surface portion 70A at the bottom of recess 92A.

Annulus 66B of upper terminal 26, if slightly flattened as shown regarding lower terminal 26A, is engageable at least on both sides at stop surface 70B by those portions of insert stop surface 96B forwardly of sides of recess 92B and adjacent cable-proximate surface 90.

Referring to FIG. 6, lower terminated conductor 26A,28A is shown fully seated, with insert 38A inserted therebehind in recess 78A. Upper terminated conductor 26,28 is shown not fully seated; latch arms 106 remain deflected into spaces 120. Upon insertion of insert 38 into recess 78, insert stop surface 96B will engage terminal stop surface 70B on annulus 66 and urge terminated conductor 26,28 fully forwardly whereupon latch arms 106 will resile and latch behind terminal stop surface 54. Insert-engaging surface 104 will be engaged by forward end of leading insert portion 98 and stop forward movement of insert 38, accurately locating the insert and preventing the terminated conductors from being pushed by the insert farther forward than desired and possibly stressing and overriding narrowed entrances 110.

Figure 7:
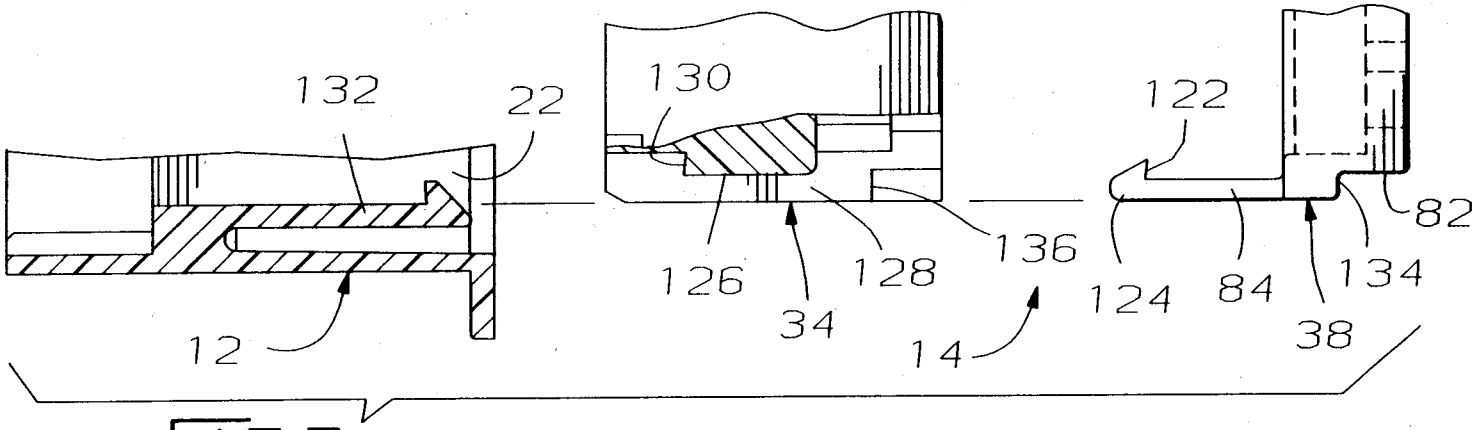
FIGS. 7 and 8 are a part plan-part longitudinal section view showing an insert to be latched into a housing, with the housing with insert to be latched into a shell, and assembled in FIG. 8.
Figure 8:
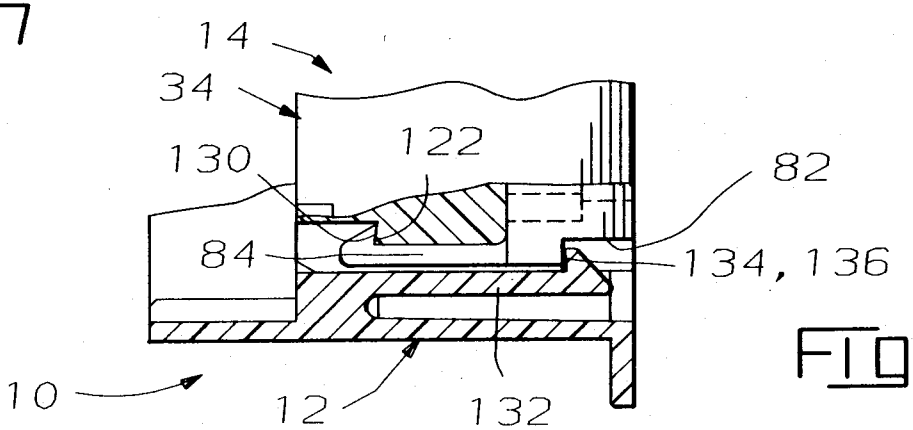

With reference to FIGS. 7 and 8, insert 38 is secured to module housing 34 by latch arms 84 extending forwardly from lateral ends 82. Latch projections 122 at free ends 124 ride over side surfaces 126 of module housing 34 within channels 128, and resile and latch at latch surfaces 130 facing forwardly and preferably slightly inwardly in FIG. 7. In FIG. 8 a module 14 has been placed and latched within aperture 22 of receptacle shell 12 by shell latch arm 132 latching behind aligned insert shoulder 134 and housing shoulder 136.

Referring to FIG. 1, housing shell 12 of receptacle connector assembly 10 receives terminated conductors 18,20 into respective passageways 48A in central region 48 similar to passageways 30 of module housing 34, with wall portions similar to portions 76 of FIG. 3 to stabilize terminals 18 therein, after which inserts 44 are latched to housing shell 12 similarly to inserts 38 latched to module housing 34 in FIG. 7. Receptacle connector assembly 10 is complete when modules 14,16 are secured, keyed and polarized in apertures 22,24 as shown in FIG. 8. The present invention provides a system of stabilizing a terminal within a passageway irrespective of its angular orientation utilizing a novel stabilizing annulus at the rearward terminal end cooperating with novel passageway wall portions. The present invention also provides a system of secondarily retaining the terminated conductors within the passageways by stopping rearward movement thereof utilizing a novel insert cooperable with the novel stabilizing annulus, and also operable over all angular terminal orientations, with additional advantages of being delatchable to permit removal and replacement of a terminal and also fully seating a partially seated terminal into its passageway. The terminals remain stabilized within the passageways even in the absence of the insert, and remain stabilized and retained even if the annulus is somewhat out of round.

Variations may occur in the terminal stabilizer, stabilizing housing wall portions, and the secondary retention insert, which are within the spirit of the invention and the scope of the claims.

What is claimed is:

1. A retention system for assuring the retention of terminals terminated to electrical conductors of cables within respective passageways of a connector housing into which they are insertable, comprising:

housing means having a plurality of passageways arranged in at least one row extending therethrough from a rearward face to a mating face and adapted to receive thereinto from said rearward face respective terminals terminated to electrical conductors of cables, said passageways of said at least one row communicating at rearward ends thereof with an insert-receiving cavity extending along a common side thereof and forwardly from said rearward housing face;

terminals terminated at conductor-connecting sections to electrical conductors of respective insulated cables and adapted to be insertable into corresponding said passageways from said rearward housing face, each said terminal including a contact section at a forward end thereof and further including an annulus rearward of said conductor-connecting section and defining a substantially annular rearwardly facing stop means spaced radially from the insulation of a respective said cable after termination substantially around the circumference of the cable, each said stop means being adjacent said insert-receiving cavity of said housing means after assembly of said terminal in said housing means;

an insert member associated with said at least one row of said passageways, said insert member including a transverse body section adapted to be received into and within said insert-receiving cavity of said housing means after said terminated terminals have been assembled into said at least one row of passageways, said body section including a cable-proximate portion extending transversely toward and to the cables of said at least one row after assembly rearward from said terminals and including a surface having semi-cylindrical recesses within which portions of said cables are disposed, and a forwardly facing surface of said cable-proximate portion defining forwardly facing stop surface means at least at locations corresponding to each said passageway of said row and adapted to stoppingly engage a said terminal in said passageway behind said stop means of said annulus thereof; and means for securing said insert member in said insert-receiving cavity of said housing means when said stop surface means stoppingly engage said stop means of the terminals of said at least one row, whereby said terminals of said row are assuredly secured against rearward withdrawal from said housing means in any angular orientation within the insert-receiving cavity.

2. A retention system as set forth in claim 1 wherein said terminal includes an insulation-gripping section between said conductor-connecting section and said insert-engaging section thereof.

3. A retention system as set forth in claim 1 wherein a said terminal includes retention means forwardly of said conductor-connection section thereof and associated with corresponding retention means of a respective said passageway comprising a primary terminal retention system locating, stabilizing and securing said terminal in said passageway.

4. A retention system as set forth in claim 1 wherein said housing means includes a transverse cable-proximate portion opposed from said cable-proximate portion of said insert member and including a surface having channels within which portions of said cables are disposed, whereby the channels of the housing and those of the cable-proximate insert portion cooperate to laterally stabilize the cables in all angular directions at the rearward housing face.

5. A retention system as set forth in claim 1 wherein said insert member includes rearwardly facing stop surfaces at ends of said body section for latching engagement by latching means of a housing shell member into which said housing means is insertable after assembly of said terminals and insert member thereto aligned with stop surfaces of said housing means.

6. A retention system as set forth in claim 1 wherein said insert member includes a latch arm extending forwardly from each end of said body section, said housing means includes arm-receiving channel means extending forwardly from each end of said insert-receiving cavity, and said latch arms and said arm-receiving channel means including associated latching means comprising said securing means.

7. A retention means as set forth in claim 6 wherein said housing means is adapted to provide access to said latch arms after assembly for delatching thereof for removal of said insert member.

* * * * *